US011839010B2

(12) United States Patent
Aoun et al.

(10) Patent No.: US 11,839,010 B2
(45) Date of Patent: Dec. 5, 2023

(54) INDUCTION COIL ARRANGEMENT FOR HEATING SMOKABLE MATERIAL

(71) Applicant: BRITISH AMERICAN TOBACCO (INVESTMENTS) LIMITED, London (GB)

(72) Inventors: Walid Abi Aoun, London (GB); Gary Fallon, London (GB); Julian Darryn White, Cambridge (GB); Martin Daniel Horrod, Cambridge (GB)

(73) Assignee: Nicoventures Trading Limited, London (GB)

( * ) Notice: Subject to any disclaimer, the term of this patent is extended or adjusted under 35 U.S.C. 154(b) by 923 days.

(21) Appl. No.: 16/492,651

(22) PCT Filed: Mar. 27, 2018

(86) PCT No.: PCT/EP2018/057813
§ 371 (c)(1),
(2) Date: Sep. 10, 2019

(87) PCT Pub. No.: WO2018/178095
PCT Pub. Date: Oct. 4, 2018

(65) Prior Publication Data

US 2021/0137167 A1 May 13, 2021

(30) Foreign Application Priority Data

Mar. 31, 2017 (GB) ..... 1705259

(51) Int. Cl.
*A24F 13/00* (2006.01)
*H05B 6/36* (2006.01)
(Continued)

(52) U.S. Cl.
CPC ..... *H05B 6/362* (2013.01); *A24F 40/465* (2020.01); *A24F 40/57* (2020.01); *H05B 6/065* (2013.01);
(Continued)

(58) Field of Classification Search
CPC ..... A24F 47/00
(Continued)

(56) References Cited

U.S. PATENT DOCUMENTS 5,613,505 A 3/1997 Campbell
9,820,512 B2 * 11/2017 Mironov ..... A24F 40/465
(Continued)

FOREIGN PATENT DOCUMENTS

AU 2018241875 B2 4/2021
CN 106455713 A 2/2017
(Continued)

OTHER PUBLICATIONS

International Search Report and Written Opinion, Application No. PCT/EP/2018/057813, dated Jun. 25, 2018, 13 pages.
(Continued)

*Primary Examiner* — Phuong K Dinh
(74) *Attorney, Agent, or Firm* — Patterson Thuente PA

(57) ABSTRACT

Disclosed is an induction coil arrangement for use with an apparatus for heating smokable material to volatilize at least one component of the smokable material. The induction coil arrangement includes a plate having opposite first and second sides, a first flat spiral coil of electrically-conductive material mounted on the first side of the plate, and a second flat spiral coil of electrically-conductive material mounted on the second side of the plate.

16 Claims, 4 Drawing Sheets

(51) Int. Cl.

| | |
|---|---|
| ***A24F 40/465*** | (2020.01) |
| ***A24F 40/57*** | (2020.01) |
| ***H05B 6/06*** | (2006.01) |
| ***H05B 6/10*** | (2006.01) |
| *A24F 40/20* | (2020.01) |
| *H05B 6/44* | (2006.01) |

(52) U.S. Cl.
CPC ..... *H05B 6/105* (2013.01); *A24F 40/20* (2020.01); *H05B 6/44* (2013.01)

(58) Field of Classification Search
USPC ..... 131/328–329
See application file for complete search history.

(56) References Cited

U.S. PATENT DOCUMENTS

| | | | | |
|---|---|---|---|---|
| 10,881,141 | B2 * | 1/2021 | Fraser | A24F 40/465 |
| 2004/0149737 | A1 * | 8/2004 | Sharpe | A24F 40/465 219/635 |
| 2016/0120221 | A1 | 5/2016 | Mironov | |
| 2016/0135505 | A1 * | 5/2016 | Li | A24F 40/46 131/329 |
| 2016/0150825 | A1 | 6/2016 | Mironov | |
| 2016/0278428 | A1 * | 9/2016 | Aldridge | A24B 15/303 |
| 2017/0055583 | A1 | 3/2017 | Blandino | |
| 2017/0079330 | A1 | 3/2017 | Mironov | |
| 2017/0097330 | A1 | 4/2017 | Mann | |
| 2017/0105454 | A1 * | 4/2017 | Li | A24F 40/44 |

FOREIGN PATENT DOCUMENTS

| | | | |
|---|---|---|---|
| CN | 206018744 | | 3/2017 |
| EP | 3732934 | A1 | 11/2020 |
| JP | 2001272811 | A | 10/2001 |
| JP | 2003297544 | A | 10/2003 |
| JP | 2012098331 | A | 5/2012 |
| JP | 2016143571 | A | 8/2016 |
| JP | 4995898 | B2 | 8/2021 |
| RU | 2596951 | C1 | 9/2016 |
| TW | 200911188 | A | 3/2009 |
| WO | WO 2008129662 | | 10/2008 |
| WO | WO 2015177044 | | 11/2015 |
| WO | WO 2015177045 | | 11/2015 |
| WO | 2016124780 | A1 | 8/2016 |
| WO | 2016166670 | A1 | 10/2016 |
| WO | 2017036955 | A2 | 3/2017 |
| WO | 2020047417 | A1 | 3/2020 |

OTHER PUBLICATIONS

Communication pursuant to Article 94(3) EPC for Application No. 18717853.8, dated Jan. 4, 2022, 5 pages.
Examination Report No. 1 for Australian Patent Application No. 2021203158, dated Mar. 31, 2022, 5 pages.
International Preliminary Report on Patentability for Application No. PCT/EP2018/057813, dated Oct. 10, 2019, pages.
Notice of Allowance for Chinese Application No. 201880018657.7, dated Apr. 6, 2022, 2 pages.
Notice of Reason for Refusal for Japanese Application No. 2019-548621 dated Nov. 24, 2020, 8 pages.
Notice of Reason for Refusal for Japanese Application No. 2019-548621, dated Apr. 6, 2021, 8 pages.
Office Action for Canadian Application No. 3,057,901, dated Aug. 24, 2021, 5 pages.
Office Action for Chinese Application No. 201880018657.7, dated Dec. 3, 2021, 14 pages.
Office Action for Chinese Application No. 201880018657.7, dated Mar. 29, 2021, 16 pages.
Office Action For Korean Application No. 10-2019-7028184, dated Apr. 1, 2021, 11 pages.
Office Action For Korean Application No. 10-2019-7028184, dated Nov. 25, 2021, 6 pages.
Office Action dated Nov. 6, 2020 for Canadian Application No. 3,057,901, 4 pages.
Office Action dated Jul. 26, 2022 for Canadian Application No. 3,057,901, 4 pages.

* cited by examiner

INDUCTION COIL ARRANGEMENT FOR HEATING SMOKABLE MATERIAL

PRIORITY CLAIM

The present application is a National Phase entry of PCT Application No. PCT/EP2018/057813, filed Mar. 27, 2018, which claims priority from GB Patent Application No. 1705259.8, filed Mar. 31, 2017, each of which is hereby fully incorporated herein by reference.

TECHNICAL FIELD

The present disclosure relates to an apparatus for heating smokable material to volatilize at least one component of the smokable material, to induction coil arrangements for use with an apparatus for heating smokable material to volatilize at least one component of the smokable material, and to systems comprising articles comprising smokable material and an apparatus for heating the smokable material to volatilize at least one component of the smokable material.

BACKGROUND

Smoking articles such as cigarettes, cigars and the like burn tobacco during use to create tobacco smoke. Attempts have been made to provide alternatives to these articles by creating products that release compounds without combusting. Examples of such products are so-called "heat not burn" products or tobacco heating devices or products, which release compounds by heating, but not burning, material. The material may be, for example, tobacco or other non-tobacco products, which may or may not contain nicotine.

SUMMARY

A first aspect of the present disclosure provides an induction coil arrangement for use with an apparatus for heating smokable material to volatilize at least one component of the smokable material, the induction coil arrangement comprising: a plate having opposite first and second sides; a first flat spiral coil of electrically-conductive material mounted on the first side of the plate; and a second flat spiral coil of electrically-conductive material mounted on the second side of the plate.

In an exemplary embodiment, the induction coil arrangement comprises an electrically-conductive connector electrically-connecting the first flat spiral coil to the second flat spiral coil. In an exemplary embodiment, the electrically-conductive connector extends from a radially-inner end of the first flat spiral coil to a radially-inner end of the second flat spiral coil.

In an exemplary embodiment, when observed from one side of the induction coil arrangement, the first flat spiral coil follows a clockwise path from a radially-inner end of the first flat spiral coil, and the second flat spiral coil follows an anti-clockwise path from a radially-inner end of the second flat spiral coil.

In an exemplary embodiment, the induction coil arrangement comprises a laminate, wherein the laminate has a first layer comprising the first flat spiral coil and a second layer comprising the second flat spiral coil. The first and second layers may be spaced apart, such as by an intermediate layer of the laminate. When provided, the intermediate layer should be electrically-insulating. In an exemplary embodiment, the laminate is or comprises a printed circuit board.

In an exemplary embodiment, each of the first and second flat spiral coils is a rectangular, such as square, coil. In another exemplary embodiment, each of the first and second flat spiral coils is a circular coil.

In an exemplary embodiment, the first and second flat spiral coils are axially aligned with each other.

In an exemplary embodiment, the plate is planar or substantially planar.

A second aspect of the present disclosure provides a structure comprising plural induction coil arrangements according to the first aspect of the present disclosure, and a retainer to which the respective plates of the induction coil arrangements are connected to fix the induction coil arrangements in position relative to one another.

In an exemplary embodiment, the retainer comprises or houses a controller for controlling operation of the flat spiral coils. In an exemplary embodiment, the controller is for controlling operation of at least one of the flat spiral coils independently of at least one other of the flat spiral coils.

A third aspect of the present disclosure provides an apparatus for heating smokable material to volatilize at least one component of the smokable material, the apparatus comprising the induction coil arrangement of the first aspect of the present disclosure or the structure of the second aspect of the present disclosure.

In an exemplary embodiment, the apparatus is a tobacco heating product.

A fourth aspect of the present disclosure provides an apparatus for heating smokable material to volatilize at least one component of the smokable material, the apparatus comprising: a heating zone for receiving one or more articles comprising smokable material; and a magnetic field generator for generating varying magnetic fields that penetrate respective longitudinal portions of the heating zone in use, wherein the magnetic field generator comprises a plurality of flat spiral coils of electrically-conductive material arranged sequentially and in respective planes along a longitudinal axis of the heating zone.

In an exemplary embodiment, the planes are parallel or substantially parallel to one another.

In an exemplary embodiment, the heating zone extends through a hole in each of the plurality of flat spiral coils.

In an exemplary embodiment, the apparatus has a support, such as an elongate support, for supporting an article comprising smokable material in the holes in the flat spiral coils. In an exemplary embodiment, the support is tubular and encircles the heating zone. In other embodiments, the support is non-tubular.

In an exemplary embodiment, the apparatus has a heating element that comprises heating material that is heatable by penetration with one or more of the varying magnetic fields to heat the heating zone. In an exemplary embodiment, the support is or comprises the heating element.

In an exemplary embodiment, the heating material comprises one or more materials selected from the group consisting of: an electrically-conductive material, a magnetic material, and a magnetic electrically-conductive material.

In an exemplary embodiment, the heating material comprises a metal or a metal alloy.

In an exemplary embodiment, the heating material comprises one or more materials selected from the group consisting of: aluminum, gold, iron, nickel, cobalt, conductive carbon, graphite, plain-carbon steel, stainless steel, ferritic stainless steel, steel, copper, and bronze.

In an exemplary embodiment, the apparatus comprises a controller for controlling operation of at least one of the flat spiral coils independently of at least one other of the flat spiral coils.

In an exemplary embodiment, the magnetic field generator comprises the induction coil arrangement of the first aspect of the present disclosure. Accordingly, the plurality of flat spiral coils of electrically-conductive material of the magnetic field generator comprise the first and second flat spiral coils of electrically-conductive material of the induction coil arrangement.

In an exemplary embodiment, the magnetic field generator comprises the structure of the second aspect of the present disclosure.

In an exemplary embodiment, the apparatus is for heating smokable material to volatilize at least one component of the smokable material without combusting the smokable material.

In an exemplary embodiment, the apparatus is a tobacco heating product.

A fifth aspect of the present disclosure provides a system for heating smokable material to volatilize at least one component of the smokable material, the system comprising: the apparatus according to the fourth aspect of the present disclosure; and the article comprising smokable material and for locating in the heating zone of the apparatus.

In an exemplary embodiment, the article is elongate.

BRIEF DESCRIPTION OF THE DRAWINGS

Embodiments of the disclosure will now be described, by way of example only, with reference to the accompanying drawings, in which.

DETAILED DESCRIPTION

Figure 1:
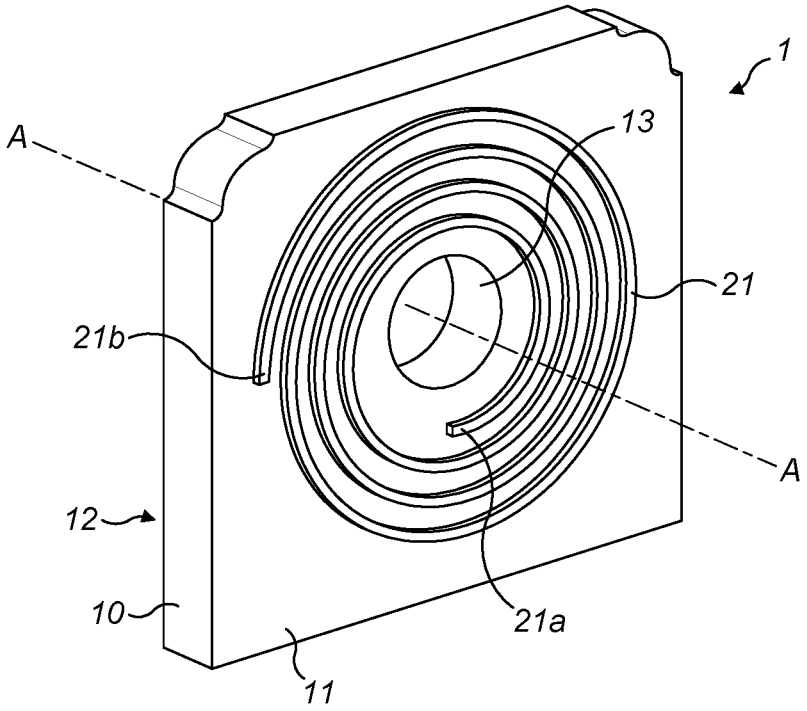
FIG. 1 shows a schematic perspective view of an example of an induction coil arrangement for use with an apparatus for heating smokable material to volatilize at least one component of the smokable material.

As used herein, the term "smokable material" includes materials that provide volatilized components upon heating, typically in the form of vapor or an aerosol. "Smokable material" may be a non-tobacco-containing material or a tobacco-containing material. "Smokable material" may, for example, include one or more of tobacco per se, tobacco derivatives, expanded tobacco, reconstituted tobacco, tobacco extract, homogenized tobacco or tobacco substitutes. The smokable material can be in the form of ground tobacco, cut rag tobacco, extruded tobacco, reconstituted tobacco, reconstituted smokable material, liquid, gel, gelled sheet, powder, or agglomerates, or the like. "Smokable material" also may include other, non-tobacco, products, which, depending on the product, may or may not contain nicotine. "Smokable material" may comprise one or more humectants, such as glycerol or propylene glycol.

As used herein, the term "heating material" or "heater material" refers to material that is heatable by penetration with a varying magnetic field.

Induction heating is a process in which an electrically-conductive object is heated by penetrating the object with a varying magnetic field. The process is described by Faraday's law of induction and Ohm's law. An induction heater may comprise an electromagnet and a device for passing a varying electrical current, such as an alternating current, through the electromagnet. When the electromagnet and the object to be heated are suitably relatively positioned so that the resultant varying magnetic field produced by the electromagnet penetrates the object, one or more eddy currents are generated inside the object. The object has a resistance to the flow of electrical currents. Therefore, when such eddy currents are generated in the object, their flow against the electrical resistance of the object causes the object to be heated. This process is called Joule, ohmic, or resistive heating. An object that is capable of being inductively heated is known as a susceptor.

It has been found that, when the susceptor is in the form of a closed electrical circuit, magnetic coupling between the susceptor and the electromagnet in use is enhanced, which results in greater or improved Joule heating.

Magnetic hysteresis heating is a process in which an object made of a magnetic material is heated by penetrating the object with a varying magnetic field. A magnetic material can be considered to comprise many atomic-scale magnets, or magnetic dipoles. When a magnetic field penetrates such material, the magnetic dipoles align with the magnetic field. Therefore, when a varying magnetic field, such as an alternating magnetic field, for example as produced by an electromagnet, penetrates the magnetic material, the orientation of the magnetic dipoles changes with the varying applied magnetic field. Such magnetic dipole reorientation causes heat to be generated in the magnetic material.

When an object is both electrically-conductive and magnetic, penetrating the object with a varying magnetic field can cause both Joule heating and magnetic hysteresis heating in the object. Moreover, the use of magnetic material can strengthen the magnetic field, which can intensify the Joule and magnetic hysteresis heating.

In each of the above processes, as heat is generated inside the object itself, rather than by an external heat source by heat conduction, a rapid temperature rise in the object and more uniform heat distribution can be achieved, particularly through selection of suitable object material and geometry, and suitable varying magnetic field magnitude and orientation relative to the object. Moreover, as induction heating and magnetic hysteresis heating do not require a physical connection to be provided between the source of the varying magnetic field and the object, design freedom and control over the heating profile may be greater, and cost may be lower.

Figure 2:
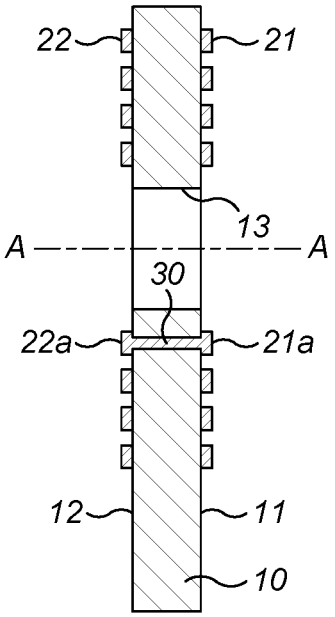
FIG. 2 shows a schematic cross-sectional view of the induction coil arrangement of FIG. 1.

Referring to FIGS. 1 and 2, there are shown schematic perspective and cross-sectional views of an example of an induction coil arrangement according to an embodiment of the disclosure. The induction coil arrangement 10 is for use with an apparatus for heating smokable material to volatilize at least one component of the smokable material, such as the apparatus 100 shown in FIG. 5 and described below.

The induction coil arrangement 1 comprises a board, panel or plate 10 and two flat spiral coils 21, 22 of electrically-conductive material, such as copper. In use, a varying (e.g. alternating) electric current is passed through each of the coils 21, 22 so as to create a varying (e.g. alternating) magnetic field that is usable to penetrate a heating element to cause heating of the heating element, as will be described in more detail below.

The plate 10 has a first side 11 and an opposite second side 12. The first and second sides 11, 12 of the plate 10 face away from each other. In this embodiment, the plate 10 is substantially planar, and the first and second sides 11, 12 are major sides of the plate 10. The plate 10 should be made from a non-electrically-conductive material, such as a plastics material, so as to electrically-insulate the coils 21, 22 from each other. In this embodiment, the plate 10 is made from FR-4, which is a composite material composed of woven fiberglass cloth with an epoxy resin binder that is flame retardant. A first 21 of the flat spiral coils of electrically-conductive material is mounted on the first side 11 of the plate 10, and a second 22 of the flat spiral coils of electrically-conductive material is mounted on the second side 12 of the plate 10. Accordingly, the plate 10 is located between the coils 21, 22.

The coils 21, 22 may be affixed to the plate 10 in any suitable way. In this embodiment, the induction coil arrangement 1 has been formed from printed circuit board (PCB), and so the first and second flat spiral coils 21, 22 have been formed by printing the electrically-conductive material onto the respective first and second sides 11, 12 of the board or plate 10 during manufacture of the PCB, and then removing (such as by etching) selective portions of the electrically-conductive material so that patterns of the electrically-conductive material in the form of the first and second flat spiral coils 21, 22 remain on the plate 10. Accordingly, the first and second flat spiral coils 21, 22 are thin films or coatings of electrically-conductive material on the plate 10.

The induction coil arrangement 1 of this embodiment therefore comprises a laminate having a first layer (comprising the first flat spiral coil 21), a second layer (comprising the second flat spiral coil 22), and an intermediate third layer (the plate 10) between the first and second layers. The plate 10 thus spaces apart the first and second layers. As the plate 10 is made of non-electrically-conductive material, the coils 21, 22 are electrically insulated from each other (other than for the electrically-conductive connector 30, discussed below). That is, the coils 21, 22 are out of contact with each other. In other embodiments, the coils 21, 22 may be electrically insulated from each other in a different way, such as by an air gap between the coils 21, 22. In some embodiments, the coils 21, 22 may be provided on the plate 10 in any other suitable way, such as by being pre-formed and then attached to the plate 10.

In some embodiments, the plate 10 may be other than a layer of a PCB. For example, it may be a layer or sheet of material such as resin or adhesive, which may have dried, cured or solidified.

The use of coils formed from thin, printed electrically-conductive material as discussed above obviates the need for Litz wire. The latter is comprised of many strands of extremely thin wire gathered in a braid, in order to overcome the effects of diminishing skin depth at higher excitation frequencies. As the tracks on a PCB are thin (typically around 38 um thick for 1 Oz Cu, and around 76 um thick for 2 Oz Cu), their performance at high frequencies can be comparable to the equivalent cross-sectional area of Litz wire, yet without problems arising in relation to brittleness, shaping the Litz wire, or connecting it to other components.

The first and second flat spiral coils 21, 22 are exposed on the plate 10, which helps enable the dissipation of any heat generated in the coils 21, 22 during use. However, in other embodiments the first and second flat spiral coils 21, 22 may instead be embedded within material that forms the plate 10, to help protect the coils 21, 22 from damage during transportation, storage and use.

In this embodiment, the induction coil arrangement 1 has an electrically-conductive connector 30 that electrically connects the first flat spiral coil 21 to the second flat spiral coil 22. More specifically, the electrically-conductive connector 30 extends from a radially-inner end 21*a* of the first flat spiral coil 21 to a radially-inner end 22*a* of the second flat spiral coil 22, so as to connect the coils 21, 22 in series. In this embodiment, the electrically-conductive connector 30 is formed as a "via" through the plate 10 of the PCB, in a way that would be understood by the person skilled in the art. In other embodiments, the electrically-conductive connector 30 may take a different form, such as an electrically-conductive lead or wire that is internal or external to the plate 10.

In this embodiment, the flat spiral coils 21, 22 are arranged in respective substantially parallel planes. That is, each of the flat spiral coils 21, 22 has a (varying) radius that is orthogonal to the plane in which the coil 21, 22 lies. Further, the flat spiral coils 21, 22 are axially-aligned with each other. That is, the virtual point from which the path of one of the coils 21, 22 emanates lies on the same axis as the virtual point from which the path of the other of the coils 21, 22 emanates, and the axis is orthogonal to each of the respective planes in which the coils 21, 22 lie. Moreover, in this embodiment, when observed from one side of the induction coil arrangement 1, the first flat spiral coil 21 follows a clockwise path from the radially-inner end 21*a* of the first flat spiral coil 21, and the second flat spiral coil 22 follows an anti-clockwise path from the radially-inner end 22*a* of the second flat spiral coil 22. In this configuration, the magnetic fields generated by the coils 21, 22 in use reinforce each other, effectively doubling the inductance of the coils 21, 22 and doubling the magnetic field along the coil axes.

As shown in FIGS. 1 and 2, an aperture 13 extends fully through the plate 10 from the first side 11 of the plate 10 to the second side 12 of the plate 10. Moreover, each of the flat spiral coils 21, 22 is wound around a hole that is substantially aligned with the aperture 13 through the plate 10. That is, there is a hole at the centre of each of the flat spiral coils 21, 22. Each of the aperture 13 and the holes is a through-hole. The varying magnetic fields generated by the coils 21, 22 in use can be used to penetrate a heating element that is located in the aperture 13 and/or in one or both of the holes, as will be described in more detail below.

The thickness, as measured from the first and second sides 11, 12 of the plate 10, of each of the first and second flat spiral coils 21, 22 may be, for example, greater than 50 micrometers and less than 200 micrometers, such as about 70 micrometers, about 100 micrometers or about 140 micrometers. In other embodiments, one or each of the coils 21, 22 may have a thickness less than 50 micrometers or more than 200 micrometers micrometers micrometers. The thickness chosen will help determine the resistance of the coils 21, 22 and the degree to which the coils 21, 22 self-heat in use. The thickness of the plate 10, as measured between the first and second sides 11, 12 of the plate 10, may for example be less than 2 millimeters, such as less than 1 millimeter.

While, in principle, more than two flat spiral coils could be provided in respective layers of a PCB, due to thermal conduction the outer layers of a PCB have two to three times greater current carrying capacity than any inner layers of the PCB. Accordingly, a double-coil structure such as that described above provides a balance between performance and complexity. Further, in this embodiment, each of the coils 21, 22 is a round or circular flat spiral coil. In other embodiments, one or each of the coils 21, 22 could instead be a rectangular (e.g. square) flat spiral coil. Whilst rectangular profile coils have a slightly higher inductance for a given profile, circular coils can be more easily interleaved and/or can have components packed between them, leading to an overall increase in PCB area utilization. A rectangular profile also required a longer track length for a given strength of magnetic field along the coil axis, which increases the resistance and reduces the Q value as compared to a circular coil of similar width.

In some embodiments, two or more of the above-described induction coil arrangements are provided as part of a structure that also comprises a retainer to which the induction coil arrangements are connected or attached. The retainer may hold the induction coil arrangements in a fixed position relative to each other, relative to the retainer, and/or relative to any other components fixed to the retainer.

Figure 3:
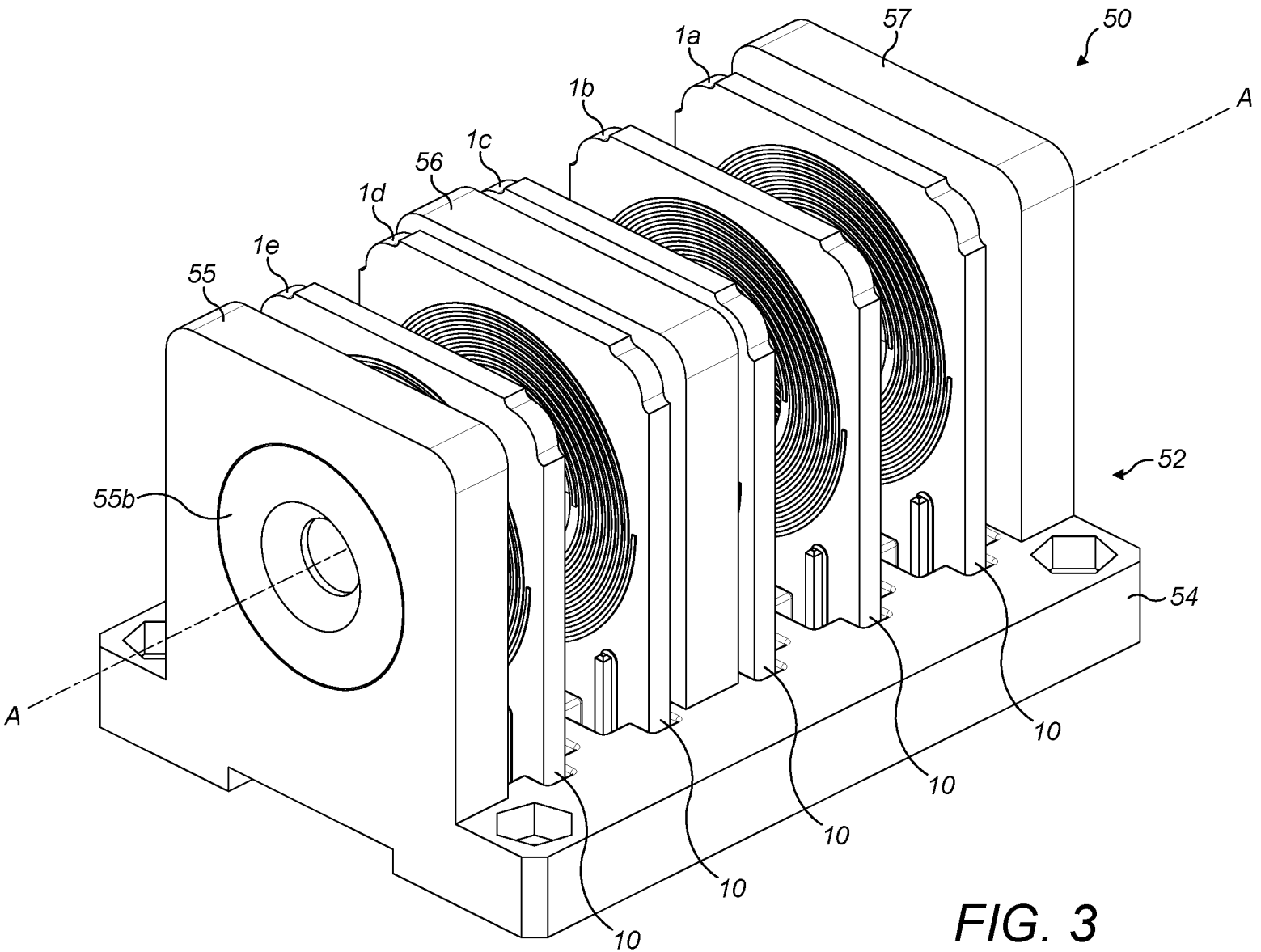
FIG. 3 shows a schematic perspective view of an example of a structure comprising plural induction coil arrangements of FIG. 1 and a retainer to which respective plates of the induction coil arrangements are connected to fix the induction coil arrangements in position relative to one another.
Figure 4:
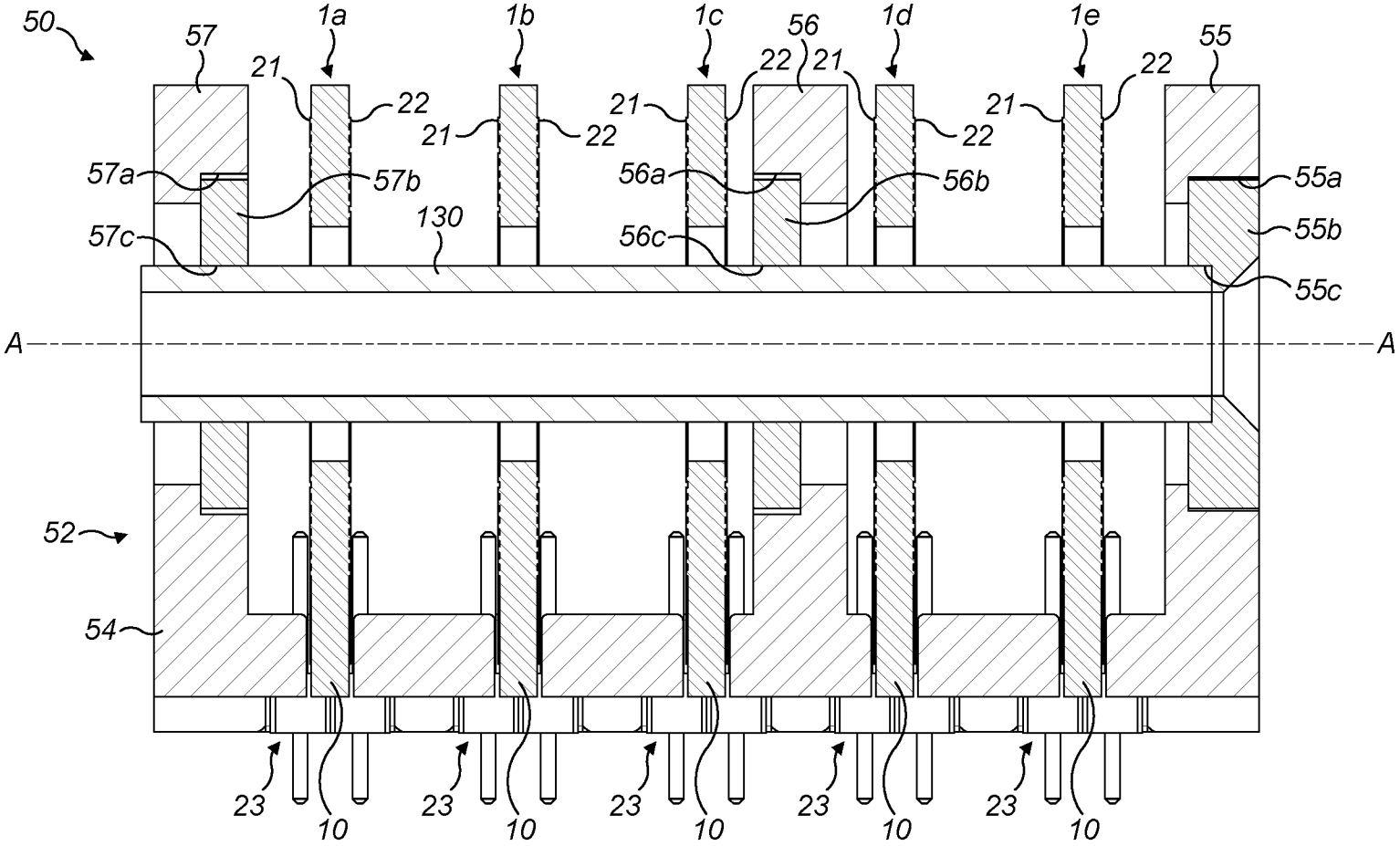
FIG. 4 shows a schematic cross-sectional view of the structure of FIG. 3.

For example, FIGS. 3 and 4 show schematic perspective and cross-sectional views of an example of a structure according to an embodiment of the disclosure. The structure 50 is for use with an apparatus for heating smokable material to volatilize at least one component of the smokable material, such as the apparatus 100 shown in FIG. 5 and described below.

The structure 50 of this embodiment comprises first to fifth induction coil arrangements 1*a*, 1*b*, 1*c*, 1*d*, 1*e*, each of which is identical to the induction coil arrangement 1 shown in FIGS. 1 and 2. The structure 50 further comprises a retainer 52 to which the respective plates 10 of the induction coil arrangements 1*a*, 1*b*, 1*c*, 1*d*, 1*e* are attached to fix the induction coil arrangements 1*a*, 1*b*, 1*c*, 1*d*, 1*e* in position relative to one another. In this embodiment, the retainer 52 is 3D printed SLS (selective laser sintering) nylon. In other embodiments, the retainer 2 may be formed in any other suitable way, such as from a PCB, or from any other suitable material. In this embodiment, the retainer 52 comprises a base 54 and the induction coil arrangements 1*a*, 1*b*, 1*c*, 1*d*, 1*e* extend away from the base 54 in a direction orthogonal or normal to a surface of the base 54.

In this embodiment, the induction coil arrangements 1*a*, 1*b*, 1*c*, 1*d*, 1*e* are separate components from the retainer 52, and are assembled together with the retainer 52 during formation of the structure 50. Each of the induction coil arrangements 1*a*, 1*b*, 1*c*, 1*d*, 1*e* comprises electrical connectors 23 for both electrically connecting the coils 21, 22 to circuitry and for anchoring the induction coil arrangements 1*a*, 1*b*, 1*c*, 1*d*, 1*e* to the retainer 52. In other embodiments, each of the arrangements 1*a*, 1*b*, 1*c*, 1*d*, 1*e* may comprise electrical connectors for connecting the coils 21, 22 to circuitry, and one or more additional structural connector(s) for anchoring the induction coil arrangements 1*a*, 1*b*, 1*c*, 1*d*, 1*e* to the retainer 52. In still further variations to this embodiment, the retainer 52 may be integrally formed with the plates 10 (and, in some cases, also with the coils 21, 22) of the induction coil arrangements 1*a*, 1*b*, 1*c*, 1*d*, 1*e*.

As shown in FIGS. 3 and 4, the retainer 52 holds the induction coil arrangements 1*a*, 1*b*, 1*c*, 1*d*, 1*e* relative to one another so that the flat spiral coils 21, 22 of the induction coil arrangements 1*a*, 1*b*, 1*c*, 1*d*, 1*e* are arranged sequentially and in respective planes along an axis A-A. In this embodiment, the flat spiral coils 21, 22 of the induction coil arrangements 1*a*, 1*b*, 1*c*, 1*d*, 1*e* lie in respective substantially parallel planes, each of which is orthogonal to the axis A-A. Further, the flat spiral coils 21, 22 are all axially-aligned with each other, since the respective virtual points from which the paths of the coils 21, 22 emanate all lie on a common axis, in this case the axis A-A. In addition, the holes 13 through the respective plates 10 are all axially-aligned with each other, and all lie on the same axis A-A as the respective virtual points from which the paths of the coils 21, 22 emanate.

In this embodiment, the structure 50 comprises a controller (not shown) for controlling operation of the flat spiral coils 21, 22. The controller is housed in the retainer 52 and comprises an integrated circuit (IC), but in other embodiments the controller may take a different form. In some embodiments, the controller is for controlling operation of at least one of the induction coil arrangements 1*a*, 1*b*, 1*c*, 1*d*, 1*e* independently of at least one other of the induction coil arrangements 1*a*, 1*b*, 1*c*, 1*d*, 1*e*. For example, the controller may supply electrical power to the coils 21, 22 of each of the induction coil arrangements 1*a*, 1*b*, 1*c*, 1*d*, 1*e* independently of the coils 21, 22 of the other induction coil arrangements 1*a*, 1*b*, 1*c*, 1*d*, 1*e*. In some embodiments, the controller may supply electrical power to the coils 21, 22 of each of the induction coil arrangements 1*a*, 1*b*, 1*c*, 1*d*, 1*e* sequentially. Alternatively, in one mode of operation at least, the controller may be for controlling operation of all of the induction coil arrangements 1*a*, 1*b*, 1*c*, 1*d*, 1*e* simultaneously.

The retainer 52 further comprises three arms 55, 56, 57 that extend away from the base 54 in a direction orthogonal or normal to a surface of the base 54, and substantially parallel to the induction coil arrangements 1*a*, 1*b*, 1*c*, 1*d*, 1*e*. In this embodiment, the arms 55, 56, 57 are 3D printed SLS (selective laser sintering) nylon and are integral with the base 52. In other embodiments, the arms 55, 56, 57 may be separate components from the base 54, which are assembled together with the base 54.

Each of the arms 55, 56, 57 has an opening 55*a*, 56*a*, 57*a* therethrough, and in each of the openings 55*a*, 56*a*, 57*a* is located an annular washer or shim 55*b*, 56*b*, 57*b*. Each of the shims 55*b*, 56*b*, 57*b* is made from a dielectric or electrically-insulating material, such as polyether ether ketone (PEEK) or glass. PEEK has a relatively high melting point compared to most other thermoplastics, and is highly resistant to thermal degradation. Each of the shims 55*b*, 56*b*, 57*b* defines a hole 55*c*, 56*c*, 57*c* therethrough. The holes 55*c*, 56*c*, 57*c* all lie on the same axis A-A as the respective virtual points from which the paths of the coils 21, 22 emanate.

The structure 50 further comprises an elongate support 130 for supporting, in use, an article comprising smokable material. In this embodiment, the support 130 is tubular and has a longitudinal axis that is coaxial with the axis A-A. In other embodiments, the support 130 may be non-tubular. The support 130 is held in position by the shims 55*b*, 56*b*, 57*b* and extends through the holes in the plurality of flat spiral coils 21, 22, through the holes 55*c*, 56*c*, 57*c* in the shims 55*b*, 56*b*, 57*b*, through the openings 55*a*, 56*a*, 57*a* in the arms 55, 56, 57, and through the apertures 13 in the plates 10. The shims 55*b*, 56*b*, 57*b* help prevent the elongate support 130 contacting the induction coil arrangements 1*a*, 1*b*, 1*c*, 1*d*, 1*e*, and particularly the coils 21, 22 thereof.

In this embodiment, the support 130 comprises heating material that is heatable by penetration with varying magnetic fields to heat an interior volume of the support 130. More specifically, in use the respective varying magnetic fields generated by the coils 21, 22 penetrate the support 130. Accordingly, respective portions of the heating element 130 are heatable by penetration with the respective varying magnetic fields. The support 130 therefore acts as a heating element in use. The controller may be configured to cause heating of the respective portions of the heating element 130 for example at different respective times, for different respective durations, and/or at different respective rates.

In other embodiments, the support 130 may be free from heating material. For example, in some embodiments, the support 130 may be made from non-electrically-conductive material, such as glass or a plastics material. In still further embodiments, the support 130 may be omitted.

Figure 5:
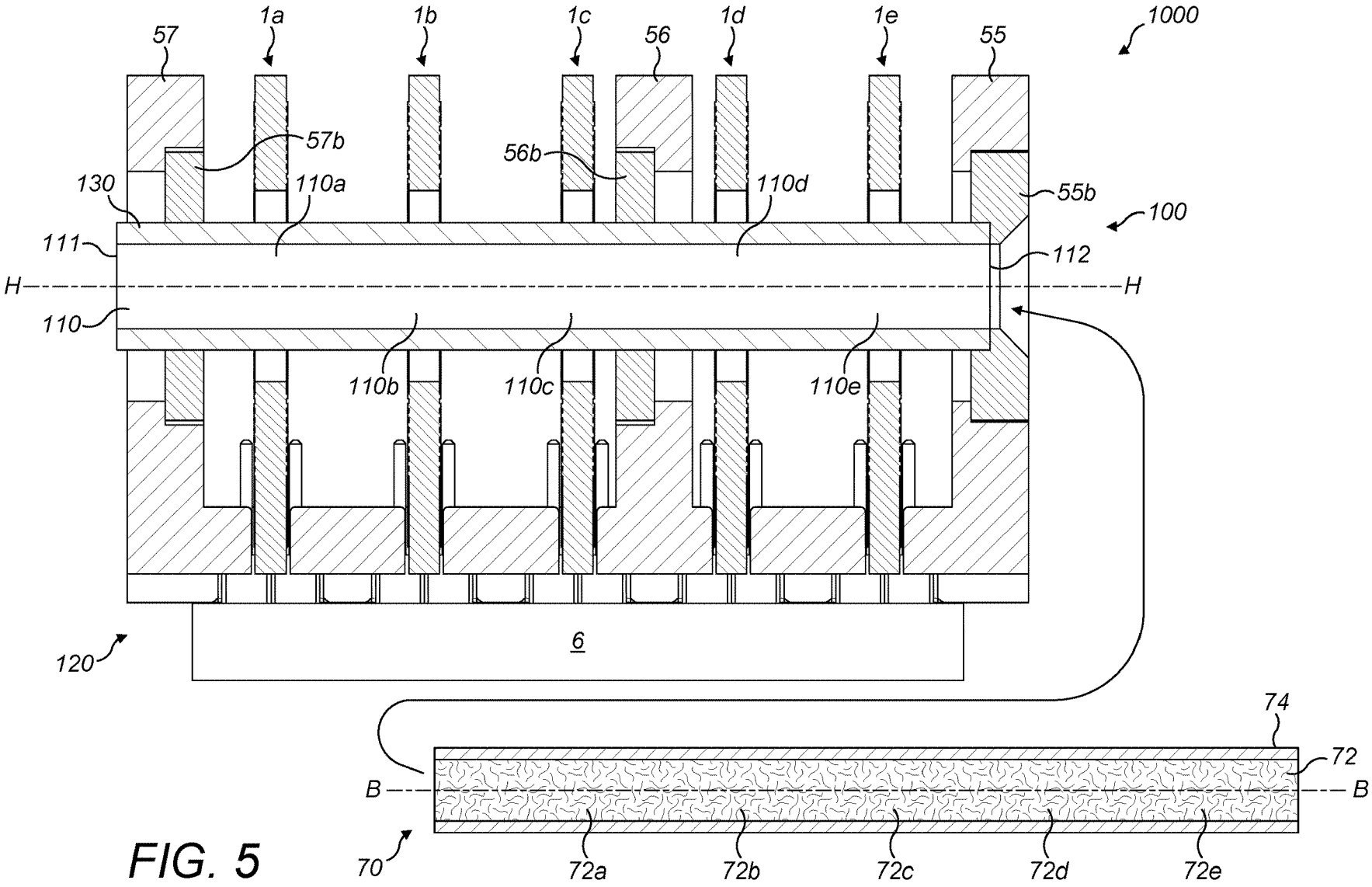
FIG. 5 shows a schematic cross-sectional view of an example of a system comprising an apparatus for heating smokable material to volatilize at least one component of the smokable material and an article comprising the smokable material and for locating in a heating zone of the apparatus.

Referring to FIG. 5, there is shown a schematic cross-sectional view of an example of a system according to an embodiment of the disclosure. The system 1000 comprises an article 70 comprising smokable material 72, and an apparatus 100 for heating the smokable material 72 to volatilize at least one component of the smokable material 72. In this embodiment, the smokable material 72 comprises tobacco, and the apparatus 100 is a tobacco heating product (also known in the art as a tobacco heating device or a heat-not-burn device).

In this embodiment, the smokable material 72 is in the form of a rod, and the article 70 comprises a cover 74 around the smokable material 72. The cover 74 encircles the smokable material 72, and helps to protect the smokable material 72 from damage during transport and use of the article 70. During use, the cover 74 may also help to direct the flow of air into and through the smokable material 72, and may help to direct the flow of vapor or aerosol through and out of the smokable material 72. In this embodiment, the cover 74 comprises a wrapper that is wrapped around the smokable material 72 so that free ends of the wrapper overlap each other. The wrapper thus forms all of, or a majority of, a circumferential outer surface of the article 70. The wrapper may be formed from paper, reconstituted tobacco, aluminum, or the like. The cover 74 also comprises an adhesive (not shown) that adheres the overlapped free ends of the wrapper to each other. The adhesive may comprise one or more of, for example, gum Arabic, natural or synthetic resins, starches, and varnish. The adhesive helps prevent the overlapped free ends of the wrapper from separating. In other embodiments, the adhesive and/or the cover 74 may be omitted. In still other embodiments, the article may take a different form to any of those discussed above.

Broadly speaking, the apparatus 100 comprises an elongate heating zone 110 for receiving the article 70, and a magnetic field generator 120 for generating varying magnetic fields that penetrate respective portions 110*a*, 110*b*, 110*c*, 110*d*, 110*e* of the heating zone 110 in use. In this embodiment, the heating zone 110 comprises a recess for receiving the article 70. The article 70 may be insertable into the heating zone 110 by a user in any suitable manner, such as through a slot in a wall of the apparatus 100, or by first moving a portion of the apparatus 100, such as a mouthpiece, to access the heating zone 110. In other embodiments, the heating zone 110 may be other than a recess, such as a shelf, a surface, or a projection, and may require mechanical mating with the article in order to co-operate with, or receive, the article. In this embodiment, the heating zone 110 is sized and shaped to accommodate the whole article 70. In other embodiments, the heating zone 110 may be dimensioned to receive only a portion of the article 70 in use.

The apparatus 100 has an air inlet (not shown) that fluidly connects the heating zone 110 with the exterior of the apparatus 100, and an outlet (not shown) for permitting volatilized material to pass from the heating zone 110 to an exterior of the apparatus 100 in use. A user may be able to inhale the volatilized component(s) of the smokable material 72 by drawing the volatilized component(s) through the outlet. As the volatilized component(s) are removed from the heating zone 110, air may be drawn into the heating zone 110 via the air inlet of the apparatus 100. A first end 111 of the heating zone 110 is closest to the outlet, and a second end 112 of the heating zone 110 is closest to the air inlet.

The magnetic field generator 120 comprises a plurality of flat spiral coils 21-22 of electrically-conductive material arranged sequentially and in respective planes along a longitudinal axis H-H of the heating zone 110. More specifically, the magnetic field generator 120 of the apparatus 100 comprises the structure 50 of FIGS. 3 and 4, whereby the plurality of flat spiral coils 21, 22 of the magnetic field generator 120 are the respective pairs of coils 21, 22 of the induction coil arrangements 1*a*, 1*b*, 1*c*, 1*d*, 1*e*. The connectors 30 of the induction coil arrangements 1*a*, 1*b*, 1*c*, 1*d*, 1*e* are omitted from FIG. 5, for clarity. The induction coil arrangements 1*a*, 1*b*, 1*c*, 1*d*, 1*e* encircle the respective portions 110*a*, 110*b*, 110*c*, 110*d*, 110*e* of the heating zone 110. It will be appreciated that the planes in which the coils 21, 22 lie are substantially parallel to one another. Moreover, the planes are all substantially orthogonal to the longitudinal axis H-H of the heating zone 110, and the heating zone 110 extends through the holes in the respective flat spiral coils 21, 22.

The longitudinal axis of the support 130 is coaxial with the longitudinal axis H-H of the heating zone 110. In other embodiments, the support 130 may be non-tubular and/or may only partially encircle the heating zone 110. For example, the support may be an element or pin that penetrates the heating zone 110 so as to be encircled by the heating zone 110.

In this embodiment, the apparatus 100 comprises a controller 6 for controlling operation of the flat spiral coils 21, 22. The controller 6 may, for example, be for controlling operation of one of the flat spiral coils 21, 22 independently of at least one other of the flat spiral coils 21, 22, thereby to cause induction heating of respective portions of the heating element 130. In some embodiments, the controller 6 may supply electrical power to the coils 21, 22 of each of the induction coil arrangements 1*a*, 1*b*, 1*c*, 1*d*, 1*e* sequentially.

Although not shown, the magnetic field generator 120 also comprises an electrical power source (not shown), and a user interface (not shown) for user-operation of the controller 6. In this embodiment, the electrical power source is a rechargeable battery. In other embodiments, the electrical power source may be other than a rechargeable battery, such as a non-rechargeable battery, a capacitor or a connection to a mains electricity supply.

The controller 6 is electrically connected between the electrical power source and the coils 21, 22 of the induction coil arrangements 1*a*, 1*b*, 1*c*, 1*d*, 1*e*, and is communicatively connected to the user interface, which may be located at the exterior of the apparatus 100. The controller 6 is operated in this embodiment by user-operation of the user interface. The user interface may comprise a push-button, a toggle switch, a dial, a touchscreen, or the like.

In this embodiment, operation of the user interface by a user causes the controller 6 to cause an alternating electrical current to pass through one or more of the coils 21, 22 of the induction coil arrangements 1*a*, 1*b*, 1*c*, 1*d*, 1*e*, so as to cause the or each coil 21, 22 to generate an alternating magnetic field. The coils 21, 22 and the heating element 130 are relatively positioned so that the alternating magnetic field(s) produced by the coil(s) 21, 22 penetrate(s) the heating material of the heating element 130. When the heating material of the heating element 130 is an electrically-conductive material, this may cause the generation of one or more eddy currents in the heating material. The flow of eddy currents in the heating material against the electrical resistance of the heating material causes the heating material to be heated by Joule heating. Further, when the heating material is made of a magnetic material, the orientation of magnetic dipoles in the heating material changes with the changing applied magnetic field, which causes heat to be generated in the heating material.

In this embodiment, the article 70 is elongate with a longitudinal axis B-B. When the article 70 is located in the heating zone 110 in use, this axis B-B lies coaxial with, or parallel to, the longitudinal axis H-H of the heating zone 110. Accordingly, the heating of one of more portion(s) of the heating element 130 causes heating of one or more of the corresponding portion(s) 110*a*, 110*b*, 110*c*, 110*d*, 110*e* of the heating zone 110. In turn, this causes heating of one of more corresponding section(s) 72*a*, 72*b*, 72*c*, 72*d*, 72*e* of the smokable material 72 of the article 70, when the article 70 is located in the heating zone 110.

In some embodiments, the controller 6 is operable to cause heating of a first section of the smokable material 72 before heating of a second section of the smokable material 72. That is, the controller 6 may be operable to cause a varying electrical current to pass through one or both of the coils 21, 22 of a first of the induction coil arrangements 1 to initiate volatilization of at least one component of the first section of the smokable material 72 adjacent the first induction coil arrangement and formation of an aerosol therein, before causing a varying electrical current to pass through one or both of the coils 21, 22 of a second of the induction coil arrangements 1 to initiate volatilization of at least one component of the second section of the smokable material 72 adjacent the second induction coil arrangement 1 and formation of an aerosol therein. Accordingly, there may be provided progressive heating of the smokable material 72 of the article 70 over time.

In some embodiments, the first induction coil arrangement 1 and associated first section of the smokable material 72 may be those 1*a*, 72*a* nearest the first end 111 of the heating zone 110, and the second induction coil arrangement 1 and associated second section of the smokable material 72 may be closer to the second end 112 of the heating zone 110. This helps to enable an aerosol to be formed and released relatively rapidly from the article 70 at the first section 72*a* of the smokable material 72 relatively close to the outlet, for inhalation by a user, yet provides time-dependent release of aerosol, so that aerosol continues to be formed and released even after the first section 72*a* of the smokable material 72 has ceased generating aerosol. Such cessation of aerosol generation may occur as a result of the first section 72*a* of the smokable material 72 becoming exhausted of volatilizable components.

The apparatus 100 may comprise a temperature sensor (not shown) for sensing a temperature of the heating zone 110 or of the article 70 or of the heating element 130. The temperature sensor may be communicatively connected to the controller 6, so that the controller 6 is able to monitor the temperature. On the basis of one or more signals received from the temperature sensor, the controller 6 may adjust a characteristic of the varying or alternating electrical current passed through the coils 21, 22 as necessary, in order to ensure that the temperature of the smokable material 72 remains within a predetermined temperature range. The characteristic may be, for example, amplitude or frequency or duty cycle. Within the predetermined temperature range, in use the smokable material 72 is heated sufficiently to volatilize at least one component of the smokable material 72 without combusting the smokable material 72. Accordingly, the controller 6, and the apparatus 100 as a whole, is arranged to heat the smokable material 72 to volatilize the at least one component of the smokable material 72 without combusting the smokable material 72.

In some embodiments, the temperature range is about 150° C. to about 300° C. The temperature range may be greater than 150° C., or greater than 200° C., or greater than 250° C., for example. The temperature range may be less than 300° C., or less than 290° C., or less than 250° C., for example. In some embodiments, the upper limit of the temperature range could be greater than 300° C. In some embodiments, the temperature sensor may be omitted.

In variations to this embodiment, the support 130 may be penetrable by fewer than all of the varying magnetic fields in use. In some such variations, the non-penetrated portion(s) of the support 130 may be heated in use by thermal conduction from the penetrated portion(s) of the support 130.

In other embodiments, the support and heating element of the apparatus may be separate components. For example, the support may be a non-magnetic and/or non-electrically-conductive element, and the heating element may be a rod or pin that penetrates the heating zone 110 so as to be encircled by the heating zone 110. The support may, for example, be a tube of plastics material (such as PEEK) or glass that encircles the heating zone 110. In some embodiments, the elongate support may be omitted.

In still further embodiments, the article 70 may include at least one heating element comprising heating material that is heatable in use by penetration with one or more of the varying magnetic fields to heat the smokable material 72 of the article 70. The heating element(s) of the article 70 would be in thermal contact, and in some embodiments surface contact, with the smokable material 72 of the article 70. For example, a heating element of such an article may be elongate and extend from a first end of the article to an opposite second end of the article. The heating element of the article may be tubular or rod-shaped, for example. In some such embodiments, the smokable material may be tubular, and may be radially inwards or radially outwards of the tubular heating element of the article. In some embodiments, the article 70 may include heating material that is dispersed within the smokable material 72 of the article 70. For example, the article 70 may include a material comprising a mixture of smokable material 72 and elements, wherein each of the elements comprises heating material that is heatable by penetration with a varying magnetic field. Each of the elements may comprise a closed circuit of heating material. Some or each of the elements may be ring-shaped, spherical, or formed from a plurality of discrete strands of heating material, for example.

In some embodiments in which the article includes a heating element, the apparatus 100 is free from a heating element that is penetrable by the magnetic fields produced by the coil(s) 21, 22. In other embodiments, each of the apparatus 100 and the article 70 may comprise a heating element. For example, in variations to the embodiment illustrated in FIG. 5, the article 70 may also comprise a tubular or rod-shaped heating element. Any of the above-described ways of operating the system 1000 shown in FIG. 5 may be used correspondingly in such other embodiments.

In some embodiments, the apparatus 100 is sold, supplied or otherwise provided separately from the article 70 with which the apparatus 100 is usable. However, in some embodiments, the apparatus 100 and one or more of the articles 70 may be provided together as a system, such as a kit or an assembly, possibly with additional components, such as cleaning utensils.

In each of the above described embodiments, the article 70 is a consumable article. Once all, or substantially all, of the volatilizable component(s) of the smokable material 72 in the article 70 has/have been spent, the user may remove the article 70 from the heating zone 110 of the apparatus 100 and dispose of the article 70. The user may subsequently re-use the apparatus 100 with another of the articles 70. However, in other respective embodiments, the article may be non-consumable, and the apparatus and the article may be disposed of together once the volatilizable component(s) of the smokable material has/have been spent.

In each of the embodiments discussed above the heating material is steel. However, in other embodiments, the heating material may comprise one or more materials selected from the group consisting of: an electrically-conductive material, a magnetic material, and a magnetic electrically-conductive material. In some embodiments, the heating material may comprise a metal or a metal alloy. In some embodiments, the heating material may comprise one or more materials selected from the group consisting of: aluminum, gold, iron, nickel, cobalt, conductive carbon, graphite, plain-carbon steel, stainless steel, ferritic stainless steel, copper, and bronze. Other heating material(s) may be used in other embodiments. In some embodiments in which the heating material comprises iron, such as steel (e.g. mild steel or stainless steel), the heating element (such as the support 130) may be coated to help avoid corrosion or oxidation of the heating element in use. Such coating may, for example, comprise nickel plating, gold plating, or a coating of a ceramic or an inert polymer.

In each of the above described embodiments, the smokable material comprises tobacco. However, in respective variations to each of these embodiments, the smokable material may consist of tobacco, may consist substantially entirely of tobacco, may comprise tobacco and smokable material other than tobacco, may comprise smokable material other than tobacco, or may be free from tobacco. In some embodiments, the smokable material may comprise a vapor or aerosol forming agent or a humectant, such as glycerol, propylene glycol, triacetin, or diethylene glycol.

In order to address various issues and advance the art, the entirety of this disclosure shows by way of illustration and example various embodiments in which the claimed invention may be practiced and which provide for superior induction coil arrangements for use with apparatus for heating smokable material to volatilize at least one component of the smokable material, a superior apparatus for heating smokable material to volatilize at least one component of the smokable material, and superior systems comprising such an apparatus. The advantages and features of the disclosure are of a representative sample of embodiments only, and are not exhaustive and/or exclusive. They are presented only to assist in understanding and teach the claimed and otherwise disclosed features. It is to be understood that advantages, embodiments, examples, functions, features, structures and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist in essence of, various combinations of the disclosed elements, components, features, parts, steps, means, etc. The disclosure may include other inventions not presently claimed, but which may be claimed in future.

The invention claimed is:

1. An apparatus for heating smokable material to volatilize at least one component of the smokable material comprising an induction coil arrangement, the induction coil arrangement comprising:

a plate having opposite first and second sides;

a first flat spiral coil of electrically-conductive material mounted on the first side of the plate; and a second flat spiral coil of electrically-conductive material mounted on the second side of the plate, wherein, when observed from one side of the induction coil arrangement, the first flat spiral coil follows a clockwise path from a radially-inner end of the first flat spiral coil, and the second flat spiral coil follows an anti-clockwise path from a radially-inner end of the second flat spiral coil, and wherein the apparatus is a tobacco heating product.

2. The apparatus of claim 1, further comprising an electrically-conductive connector electrically-connecting the first flat spiral coil to the second flat spiral coil.

3. The apparatus of claim 2, wherein the electrically-conductive connector extends from a radially-inner end of the first flat spiral coil to a radially-inner end of the second flat spiral coil.

4. The apparatus of claim 1, further comprising a laminate, wherein the laminate has a first layer comprising the first flat spiral coil and a second layer comprising the second flat spiral coil.

5. A structure comprising an apparatus having plural induction coil arrangements according to claim 1, and a retainer to which the respective plates of the plural induction coil arrangements are connected to fix the plural induction coil arrangements in position relative to one another.

6. An apparatus for heating smokable material to volatilize at least one component of the smokable material, the apparatus comprising:

a heating zone for receiving one or more articles comprising smokable material;

a magnetic field generator for generating varying magnetic fields that penetrate respective longitudinal portions of the heating zone in use, wherein the magnetic field generator comprises a plurality of flat spiral coils of electrically-conductive material arranged sequentially and in respective planes along a longitudinal axis of the heating zone, wherein the heating zone extends through a hole in each of the plurality of flat spiral coils; and an elongate support for supporting an article comprising smokable material in the holes in the flat spiral coils.

7. The apparatus of claim 6, wherein the planes are substantially parallel to one another.

8. The apparatus of claim 6, wherein the elongate support is tubular and encircles the heating zone.

9. The apparatus of claim 6, further comprising a heating element that comprises heating material that is heatable by penetration with one or more of the varying magnetic fields to heat the heating zone.

10. The apparatus of claim 9, wherein the heating material comprises one or more materials selected from the group consisting of: an electrically-conductive material, a magnetic material, and a magnetic electrically-conductive material.

11. The apparatus of claim 9, wherein the heating material comprises a metal or a metal alloy.

12. The apparatus of claim 9, wherein the heating material comprises one or more materials selected from the group consisting of: aluminium, gold, iron, nickel, cobalt, conductive carbon, graphite, plain-carbon steel, stainless steel, ferritic stainless steel, steel, copper, and bronze.

13. The apparatus of claim 6, further comprising a controller for controlling operation of at least one of the flat spiral coils independently of at least one other of the flat spiral coils.

14. The apparatus of claim 6, wherein the magnetic field generator comprises:

a plurality of induction coil arrangements, each induction coil arrangement comprising:

a plate having opposite first and second sides, a first flat spiral coil of electrically-conductive material mounted on the first side of the plate, and a second flat spiral coil of electrically-conductive material mounted on the second side of the plate; and a retainer to which the respective plates of the plurality of induction coil arrangements are connected to fix the plurality of induction coil arrangements in position relative to one another.

15. A system for heating smokable material to volatilise at least one component of the smokable material, the system comprising the apparatus according to claim 6; and the one or more articles for locating in the heating zone of the apparatus.

16. An apparatus for heating smokable material to volatilize at least one component of the smokable material, the apparatus comprising:

a heating zone for receiving one or more articles comprising smokable material;

a magnetic field generator for generating varying magnetic fields that penetrate respective longitudinal portions of the heating zone in use, wherein the magnetic field generator comprises a plurality of flat spiral coils of electrically-conductive material arranged sequentially and in respective planes along a longitudinal axis of the heating zone;

a heating element that comprises heating material that is heatable by penetration with one or more of the varying magnetic fields to heat the heating zone; and an elongate support for supporting an article comprising smokable material in the holes in the flat spiral coils, wherein the support comprises the heating element.

* * * * *